United States Patent [19]

Nagasawa

[11] Patent Number: 4,748,833

[45] Date of Patent: Jun. 7, 1988

[54] BUTTON OPERATED COMBINATION LOCK

[75] Inventor: Chiyokichi Nagasawa, Kawagoe, Japan

[73] Assignee: 501 Nagasawa Manufacturing Co., Ltd., Saitama, Japan

[21] Appl. No.: 302,606

[22] Filed: Sep. 15, 1981

[30] Foreign Application Priority Data

Oct. 21, 1980 [JP] Japan ..... 55-146337

[51] Int. Cl.[4] ..... E05B 13/00

[52] U.S. Cl. ..... 70/214; 70/298; 70/315

[58] Field of Search ..... 70/298, 297, 207, 209, 70/214, 220, 224, 287, 288, 299, 129, 315, 133; 292/39, 142, 172

[56] References Cited

U.S. PATENT DOCUMENTS

| | | | |
|---|---|---|---|
| 656,157 | 8/1900 | Alm | 70/298 |
| 1,085,894 | 2/1914 | Eagle | 70/298 |
| 1,374,769 | 4/1921 | Schicke | 70/299 |
| 1,391,662 | 9/1921 | Augustyn | 70/288 |
| 2,848,782 | 8/1958 | Gillison | 292/39 X |
| 3,009,346 | 11/1961 | Check | 70/298 |
| 3,099,150 | 7/1963 | Check | 70/214 |
| 3,115,028 | 12/1963 | Windle | 70/288 |
| 3,680,336 | 8/1972 | Schendel | 70/298 X |
| 3,844,592 | 10/1974 | Giardina et al. | 292/39 |
| 3,910,078 | 10/1975 | Schulz | 70/315 X |
| 3,991,595 | 11/1976 | Bahry et al. | 292/39 X |
| 4,176,533 | 12/1979 | Nordendale | 70/288 X |
| 4,191,035 | 3/1980 | Hatch | 70/315 X |

FOREIGN PATENT DOCUMENTS

| | | | |
|---|---|---|---|
| 13300 | 9/1903 | Austria | 70/298 |
| 266642 | 10/1913 | Austria | 70/298 |
| 1198689 | 6/1959 | France | 292/39 |
| 493535 | 4/1954 | Italy | 70/288 |
| 227882 | 4/1969 | U.S.S.R. | 70/298 |

*Primary Examiner*—Lloyd A. Gall

*Attorney, Agent, or Firm*—Edward A. Sokolski

[57] ABSTRACT

This invention relates to a so-called "keyless" type button operated combination lock which can be unlocked by a button operation and locked by a handle operation. A number of buttons exposed on the front side of a case can be set in a combination and a key plate that engages with a bolt lock and keeps it in the locked state is unlocked by setting the buttons, and actuator keys to which they are attached, to a combination but prevents unlocking if the unlocking operation is erroneously carried out. These keys are made in the same shape and size, and the set positions for the memory state and the non-memory state can be interchanged by reversing key positions. These keys are loosely inserted into corresponding slits in the key plate and permit the selection of various operating conditions in conjunction with the key plate slits. When the keys are brought into the "ON" state, they are detachably hooked to the lock plate. The handle, which is operative in the interlocking arrangement with the bolt lock, permits the key plate and the lock plate to simultaneously operate under engagement with each other via a cam pin. Another cam pin engages only with the above-mentioned cam pin and with the lock plate. These cam pins are interchangeable with each other so that the lock of the invention can be fitted to the door as a right-handed type or a left-handed type.

6 Claims, 5 Drawing Sheets

BUTTON OPERATED COMBINATION LOCK

FIELD OF THE INVENTION

This invention relates to a keyless bolt lock that can be unlocked by button operation in a predetermined combination.

BACKGROUND OF THE INVENTION

As is well known, a wide variety of locks are available for use on doors. However, most of these use a cylinder type bolt look operated by a key. Combination locks are in limited use in applications that do not require a finished appearance, such as on a warehouse door, for instance. Of the hidden type locks, the key type account for the maJor proportion regardless of the application, both in home and commercial use.

In key operated locks, however, the lock can be opened only with its key or a master key. So the lock cannot be operated when the key is lost. Statistics reveal that locking errors occur extremely frequently because the operation of the key is forgotten, and key locks are not preferred from the aspect of crime prevention.

It is of course possible to fit a dial lock as is used in a safe to a door, but the use of a dial lock in an ordinary door is impracticable due to structural limitations as well as design conditions.

To cope with these problems, a so-called button lock has recently been proposed, which can be fitted to the door surface and operates a dead bolt in accordance with a combination by a button operation However, the memory mechanism used in this lock has an extremely complicated construction and is expensive to produce. If the combination is fixedly set during production of the lock, users of the lock cannot change the button combination so as to meet their various requirements, and since a common combination cannot be set, those who sell and fit the locks cannot easily handle and properly set them for operation.

SUMMARY OF THE INVENTION

The present invention is therefore directed to provide a keyless button operated lock which eliminates all the above mentioned problems, and operates with conventional locks fitted to doors. The device of the invention operates with a simple mechanism based on a rational design, which permits the button combination to be easily changed, and which has high flexibility for conditions of use and fitting.

DESCRIPTION OF THE PREFERRED EMBODIMENT

Figure 1:
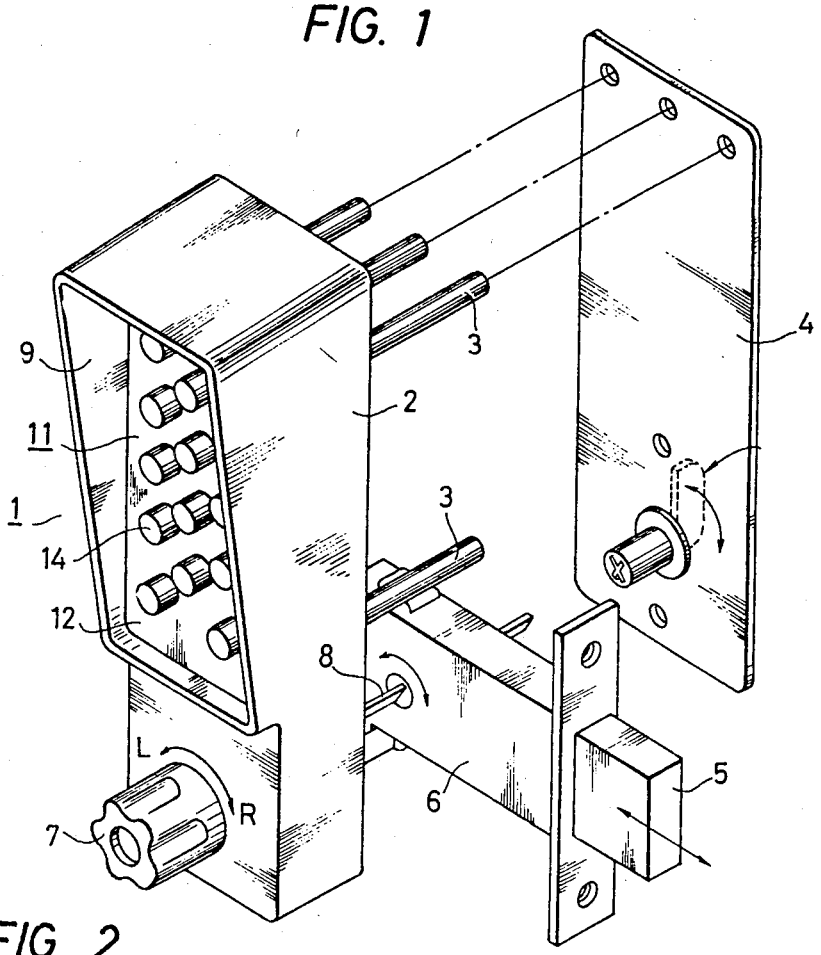
FIG. 1 is an overall perspective view of an embodiment of the present invention.

Referring to the Figures, the button lock 1 that constitutes the gist of the invention of this application consists of a case frame 2 on the front side to be clamped to a door (not shown), a backing plate 4 fastened via bridging rods 3, 3, . . . of the case frame 2 and a conventional bolt lock 6 having a dead bolt 5.

A square core rod 8 for a handle 7 of the case frame 2 is interconnected to the bolt lock 6 as a known control member.

Figure 4:
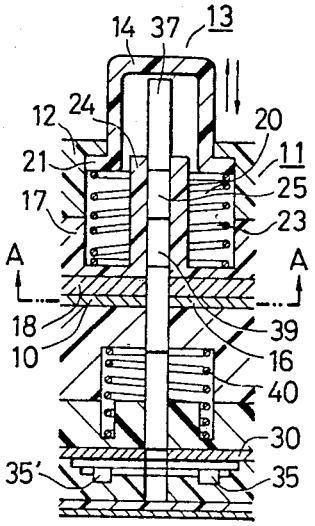
FIG. 4 is a transverse sectional view useful for explaining the operative portions of the device of the invention.
Figure 5:
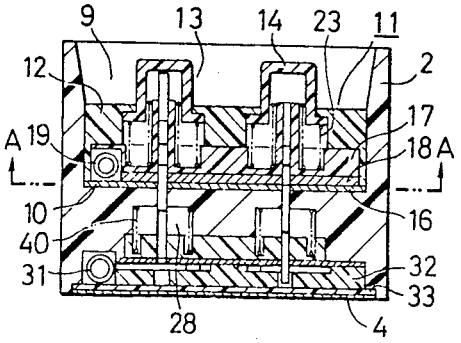
FIG. 5 is a transverse sectional view of a mechanism of the invention inside a case frame.
Figure 6:
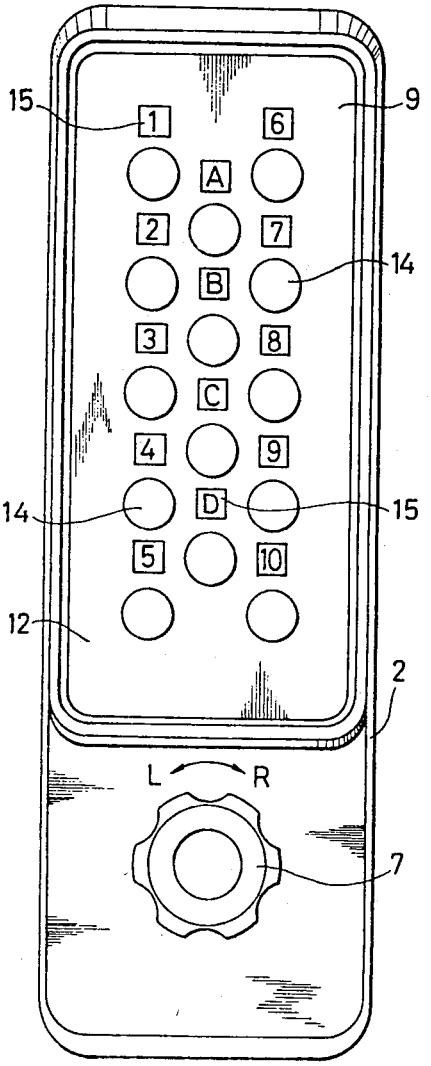
FIG. 6 is a front view of the case frame of the invention
Figure 7:
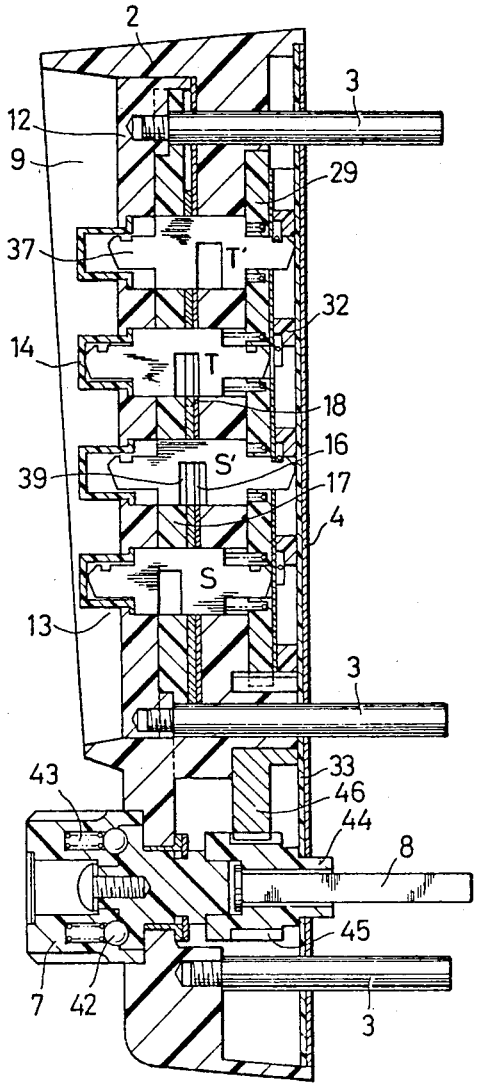
FIG. 7 is a longitudinal sectional view useful for explaining the mechanism inside the case frame.

On an inside portion 10 of a hood 9 disposed above the handle 7 of the case frame 2, a set block 11 is detachably fitted to the case frame 2 from the back by means of screws or the like (not shown) as shown in FIGS. 5 and 7 in such a manner as to permit the button combination to be changed as will be described later. Cover buttons 14, 14 . . . of a number of set buttons 13 are loosely fitted to the surface of the block 11 but not allowed to fall off therefrom as shown in FIGS. 4 and 6 and key word displays 15, 15 . . . for the numerals 1 to 10 and the letters A-D are disposed above the cover buttons 14, 14, . . . These cover buttons 14 have the same size so they can be mass-produced.

Figure 10:
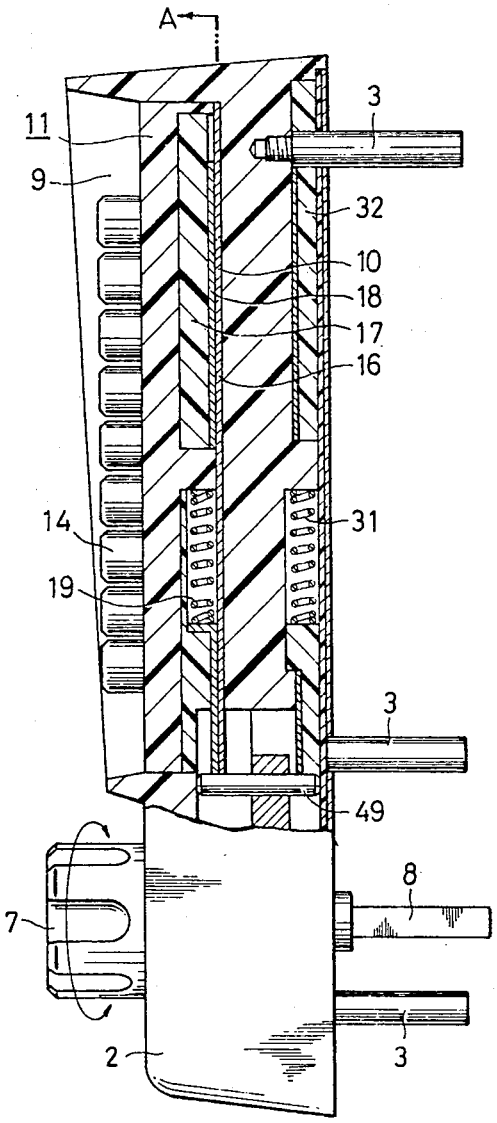
FIG. 10 is a partially longitudinal sectional view of principal portions of the device of the invention.

As shown in FIGS. 5 and 10 lock guide plate 17 and a key plate 18 are installed from the cover button (14) side between the button plate 12 of the block 11 and a button plate back plate 16. The key plate 18 is capable of sliding relative to the lock guide plate 17 and button plate back plate 16, and is urged in the return direction by a spring 19 which buts against the lock guide plate 17.

As shown in FIG. 4, each cover button 14 is also urged towards the surface of block 11 agains a stopper flange 21 of the button confronting the periphery of hole 20 of the button plate 12 by means of a spring 23

Button slits 25 are bored on an inner surface 24 of the lock guide plate 17.

Slits 26, 26 . . . are bored on the key plate 18 so as to correspond to the cover buttons 14, 14, . . .

Figure 8:
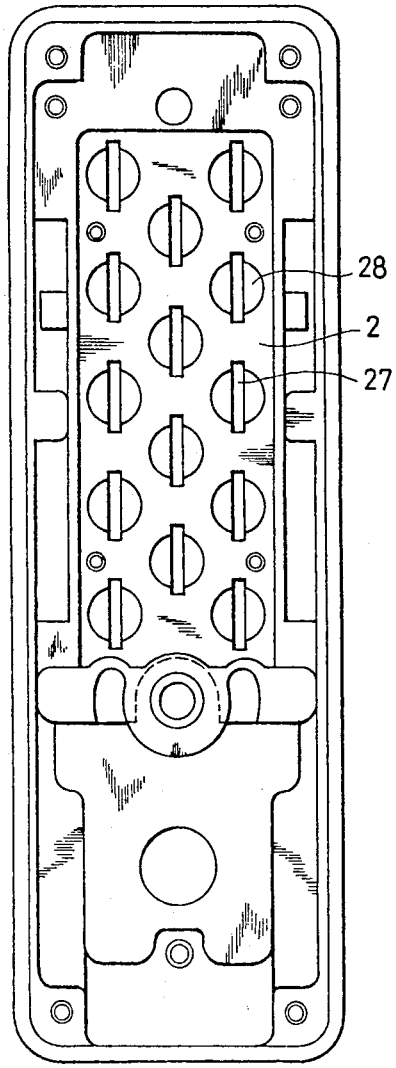
FIG. 8 is a plan view useful for explaining the operation of the slits in the case frame.

On the other hand, slits 27 and round holes 28 are bored on the case frame 2 corresponding to the back of the block 11 in such a manner as to correspond to the above-mentioned slits 25, 26, respectively, as shown in FIG. 8. Lock plates 32 are urged by springs 31 towards spring supports 29. Lock set covers 30 are interposed between the case frame 2 and a rear cover 33.

Figure 9:
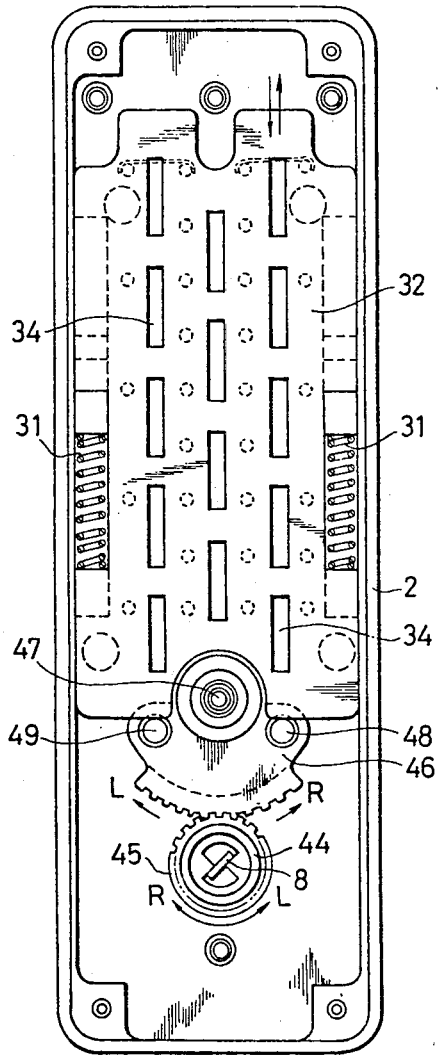
FIG. 9 a plan view useful for explaining the operation of the lock plate.
Figure 15:
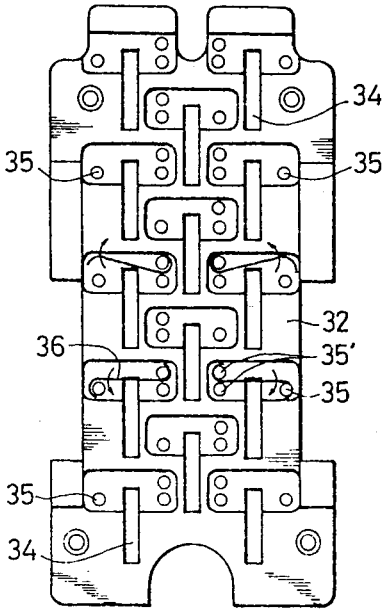
FIG. 15 is a front view of the lock plate.

A slit 34 is so bored on each lock plate 32 as to correspond to the above-mentioned slits 25, 26, 27. Referring to FIGS. 9 and 15 showing the front and back of the lock plate 32, respectively, the base end of each hook spring 36 is fixed to pins 35, 35', 35',35, 35', 35', . . . , and its tip is detachably hooked in the direction represented by the arrow in such a fashion that in its untensioned state, its span portion traverses the slit 34 in the position shown in FIG. 15.

Though only four springs 36 are shown disposed in FIG. 15 for the sake of illustration, there is a similar such spring for each of the slits 34.

Figure 3:
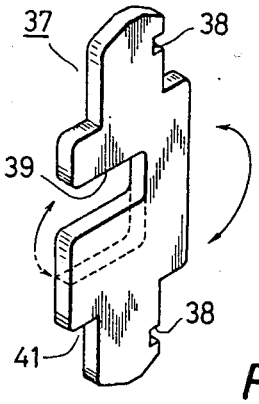
FIG. 3 is a perspective view of the key employed in the device of the invention.

Reference numeral 37 represents an actuator key, each such key having the punched-out shape of a plate as shown in FIG. 3. Hook notches 38, 38 for engaging with the above-mentioned hook springs 36 are formed at the upper and lower end portions of the key. A transverse slot 39 capable of engaging with the end of the slit 26 of the key plate 18 is formed in such a fashion that when the key 37 is vertically inverted, positions of the slot 39 are linearly symmetrical. This end result is achieved by locating the slot so that it is parallel to the transverse centerline of the actuation key and displaced from such centerline.

According to this arrangement, the key 37 can be mass-produced. A key 37 is inserted into each of the slits 25, 26, 27 and 34, and is upwardly urged by a spring 40 inserted into the case frame 2 which spring at its lower end engages spring supports 29. The upper portion of each key 37 is covered with the cover button 14.

Figure 2:
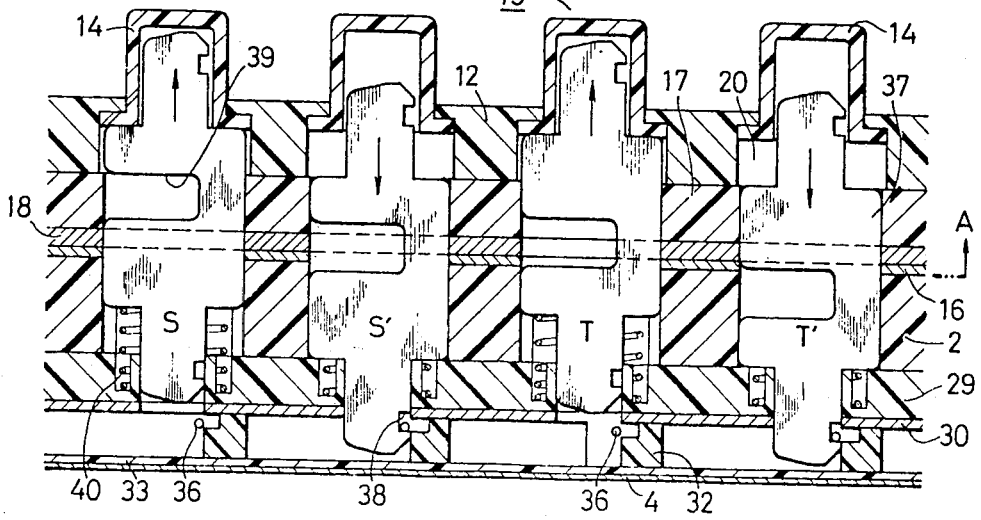
FIG. 2 is a sectional view useful for explaining the fundamental operation.

When the block 11 is removed from the case frame 2, the upright or inverted positions of each key 37 can easily be interchanged, and the keys reinserted into the slits 25, 26, 27 and 34. the unactuated state, the key 37 represented by symbol S in FIG. 2 is in the set state of the memory mode while the button represented by T is in the set state of the non-memory mode.

Symbols S' and T' represent the positions when the buttons are depressed or actuated, respectively.

The handle 7 is capable of being rotated in the R and L directions indicated by arrows in FIG. 1, and is returned to the center position by a return spring (not shown). If over-torque is applied to the handle, it is absorbed by check balls 42 in a check notch (not shown), by means of springs 43 as shown in FIG. 7.

The aforementioned square core rod 8 is fitted to a boss 44 at the base of the handle 7 and a pinion 45 is formed around the outer circumference of the handle 7 as shown in FIG. 9. This pinion 45 engages with a rack gear 46 that is pivoted to the case frame 2 by a pin 47. As viewed from the front of the case frame 2 in FIG. 9, a short cam pin 48 engaging with the lower end of the lock plate 32 is fitted tightly and replaceably on the "R" side indicated by an arrow in FIG. 9, as this is a right-hand embodiment. This is more clearly depicted in FIG. 11. On the "L" side indicated by the arrow in FIG. 9, that is, on the unlocking operation side, an elongated cam pin 49 engaging with the lower ends of the lock plate 32 and key plate 18 is also fitted tightly and replaceably as shown in FIG. 10. Accordingly, if the bolt lock 6 of FIG. 1 is to face leftward or to be used as a left-handed embodiment, the cam pins 48, 49 are interchanged and tightly fitted to the rack gear 46.

In the above mentioned construction, the basic locking and unlocking operations will now be described with reference to FIG. 2. When actuator key 37 in its memory (S) state is depressed and is brought into the S' state by means of cover button 14 with thekey pushed against the spring 40, the slot 39 is brought opposite the key plate 18 and the key plate 18 is now capable of entering and engaging with the slot 39. With the slots of all of the keys in such a position, the cam pin 49 may be displaced and the handle 7 rotated to the L side, to unlock the lock.

The key in the "T" (non-memory state) is kept with its slot 39 engaged with its key plate 18. Hence, the handle 7 can be rotated to the L side and unlocking is possible. If the button is depressed into the state T', such engagement is not possible, whereby the key plate 18 is locked, thereby blocking the operation of the cam pin 49. Hence, the handle 7 cannot be rotated to draw the bolt.

Needless to say, the key 37 is kept depressed when the hook notch 38 engages with the hook spring 36 of the lock plate 32, and it is returned by spring 40 when the hook spring 36 is disengaged from the hook notch 38 by the cam pin 48 of the lock plate 32 via the slide. Whenever the cover button 14 is depressed, it is always urged back by the spring 23.

The lock of the invention is practically operated in the following manner. In the key word display 15 shown in FIG. 6, the actuator keys of numeral 10, 9, 4, 5, for example, are set to memory state "S" (FIG. 2) with the other keys 37 set to state "T". This setting is made when the lock is assembled or when the block 11 is adjusted.

After the button lock 1 is thus fitted to a door (not shown), the dead bolt 5 is retracted into the dead lock 6 whereby the door is closed from the open state. When the handle 7 is rotated to the right or in the "R" direction in FIG. 1, the dead bolt 5 is extended via the square core rod 8 to lock the door. In FIG. 9, the pinion 45 rotates to the right and the rack gear 46 moves to the right so that the short cam pin 48 causes the lock plate 32 to slide against the spring 31.

Incidentally, since the slide of this lock plate 32 is a kind of blind slide, it slides whether or not any of the keys 37 are depressed. In such a case, the hook springs 36 immediately disengage from the hook notches 38 of the keys 37 and the keys return to this upward position.

When locked, the handle 7 returns to the neutral position by means of a spring (not shown) and the lock plate 32 is also returned to its original position by spring 31.

In the interim, since the elongated cam pin 49 rotates in the opposite direction, the key plate 18 does not slide at all.

In this state, even if an attempt is made to rotate the handle 7 in the unlocking direction, that is, to the left in FIG. 1, it cannot be rotated because the elongated cam pin 49 attempts to slide the key plate 18 via the pinion 45 and the rack gear 46, but the slot 39 of the keys 37 in the memory state "S" of FIGS. 2 and 7 are disengagaed with respect to the key plate 18 and hence interfere with the key plate 18 so it cannot slide.

The unlocking operation is then made by the button operation. If any one of the key words "10, 9, 4, 5" of the correct memory keys is erroneously depressed, for example, the buttons "10, 9, 4, 6" are set so the key "6" is depressed from non-memory state T to T', however, the key "6" is pressed by cover button 14 against the spring 40 whereby the hook notch 38 opens the hook spring 36 of the lock plate 32 as shown in FIG. 15, and engages with it as shown in FIGS. 2 and 7, and the key "6" is held in a depressed state.

So even though the other keys 37, i.e. "10, 9, 4" move from the state S to the state S' and each slot 39 for these keys engages with the key plate 18, the change of the wrongly operated button from T to T' causes its slot 39 to be disengaged from the key plate 18. Accordingly, if there is even only one wrongly actuated key in the non-memory state T among the buttons 37, the key 37 and the key plate 18 interfere with each other and hence, the key plate 18 does not slide. Even if the handle 7 is twisted in the unlocking direction "L", the elongated cam pin 49 is not able to push the key plate 18 up so that the locked state is maintained and unlocking is not possible.

Unlocking is not possible whether the button depressing operation is carried out either erroneously or with malicious intent.

Figure 11:
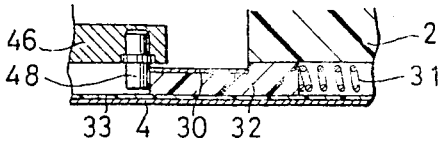
FIG. 11 is a schematic view useful for explaining the engagement between a short cam pin and the lock plate of the device of the invention.
Figure 12:
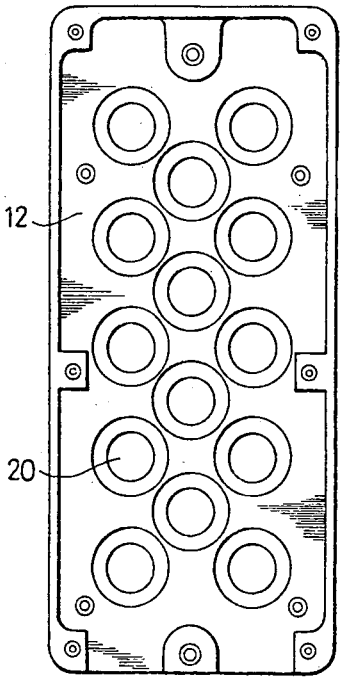
FIG. 12 is a rear view of a button plate.
Figure 13:
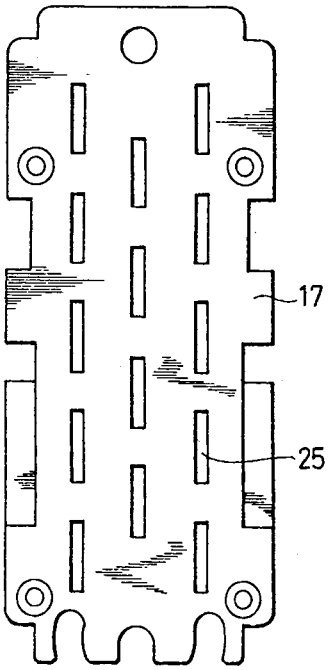
FIG. 13 is a rear view of a lock guide plate.
Figure 14:
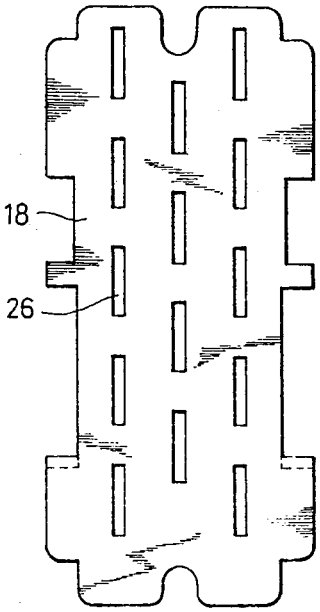
FIG. 14 is a rear view of a key plate.

If the operator of the lock knows the key words "10, 9, 4, 5" of the correct memory state in this case, he becomes aware of the fact that unlocking is not possible, and tries to perform the push button operation again. In this case, the handle 7 is again rotated in the R direction in FIG. 1, the dead bolt 5 is kept locked but the short cam pin 48 again causes the lock plate 32 to slide against the spring 31 via the pinion 45 and the rack gear 46, as shown in FIG. 11. Consequently, the hook springs 36 of the lock plate 32 are disengaged from the hook notches 38 of the buttons 37, 37, . . . that are depressed, and hence the keys 37, 37 . . . in the depressed state including both the S' and T' are states are returned to the S and T states respectively, by the springs 40, and the lock plates 32 are also returned by the springs 31. The handle 7 is also returned to the neutral position by the spring.

In this state, the memory state keys 37 are in the "S" state, so the key plate 18 can not be slid, and unlocking is not possible.

When the buttons of the correct key words "10, 9, 4, 5" are depressed, the keys 37, 37 . . . in the memory state S are brought into the S' state against the springs 40 and their slots 39, 39 . . . engage with the key plate 18 and by their hook notches 38, 38 . . . have been hooked by hook springs 36 to keep them in the depressed set position S'.

On the other hand, since the keys 37, 37 . . . in the non-memory state "T" are not depressed, their slots 39, 39 maintain their initial state of engagement with the key plate 18.

Needless to say, when the cover buttons 14, 14 . . . are released, they naturally return due to spring 23 so the combination cannot be observed from the outside.

Next, when the handle 7 is rotated to the left in the unlocking direction "L" direction and the elongated cam pin 49 engages with both lock plate 32 and key plate 18 as shown in FIG. 10, and causes both plates 32, 18 to slide against the springs 19, 31.

Since the key plates 18 are engaged with the slots 39 of all the keys 37, 37 . . . under the memory state S' and the non-memory state T as already noted, the key plate 18 may slide and all its slots 26 will enter the slots 39. As a result, the elongated cam pin 49 permits rotation of the rack gear 46, that is, rotation of the handle 7 in the unlocking direction via rotation of the pinion 45, so that the dead bolt 5 retracts into the bolt lock 6 via the square core rod 8, thereby releasing the door lock.

Since the lock plate 32 also slides by virtue of the operation of the elongated cam pin 49, the hook springs 36 also disengage from the hook notch 38 of the key 37 in the depressed memory state or in the memory state S' and are allowed to assume the return position by means of the spring 31 along with the return of the key plate 18 via the spring 19 that follows the return process of the handle 7 to the neutral position. Each key 37, 37 . . . under the memory state S', that is thus released from the hook, is allowed to return to its original position by the spring 40, whereby the "flip-flop" of the entire mechanism is reset to the initial state.

In the same way, locking and unlocking of the lock and resetting of the key words are thereafter repeated, thereby performing the keyless locking and unlocking of the lock.

If the state of the memory buttons S relating to the above-mentioned key words is standardized, such as "10 9, 6, 1" at the stage of production or wholesaling, for example, the lock can be very conviently assembled into a door by a house builder in building house.

If the key words "10, 9, 5, 8" are selected by the resident of the house at the time of delivery of the house after assembly of the lock to the door, the memory state can easily and selectively be set by the house builder of the resident of the house by himself in the following manner. Namely, the set block 11 is first removed from the case frame 2 exposing the corresponding keys 37, 37 . . ., the keys corresponding to the key words "10, 9, 5, 8" are inverted or erected in the position of the memory state S as shown in FIG. 3, and are then inserted into the slits 27 of the case frame 2 as shown in FIG. 8. After the set block 11 is again assembled to the case frame 2, all the keys 37 are inserted into the slits 25, 26, 27, 34 whereby the memory state can easily be selected and set.

Naturally, selection, change and resetting of the combination can also be made when it is accidentally learned by a third party.

The present invention is not limited to the above-mentioned embodiment, in particular. For example, the keys may be columnar or square besides their sheet-like form, and engagement and disengagement of each key with the lock plate may be effected magnetically besides the above-mentioned system using the hook spring in combination with the hook notch. Various design changes may also be made. For example, the cover button may be made of rubber, and the mechanical portions may be made of a synthetic resin. Furthermore, a waterproof cover made of a soft resin may be added.

Needless to say, the size and thickness of the lock can be reduced by reducing the number of buttons, for example.

As described in the foregoing description, in accordance with the present invention, the dead lock can be locked and unlocked by the handle operation which is locked or unlocked by the operation of a number of buttons. Fundamentally, therefore, the lock of the present invention can be locked and unlocked without a key by merely depressing the buttons of the memory combination. Thus, the lock of the present invention eliminates the necessity of troublesome key operations as well as the problem of unlocking the lock when the key is forgotten.

In locking the lock of the invention, neither a key operation nor a button operation is necessary and the lock can be locked as it is.

Since the buttons, the cam pins and the like can be produced in the same sizes, the product can be mass-produced.

By replacing the right-handed cam pins with left-handed cam pins and vice versa, the lock can be produced in either right-handed or left-handed types.

In the present invention, the memory state and the non-memory state can be set by either placing upright or inverting a large number of keys having the slits for establishing the memory state, and the lock can advantageously be mass-produced by mass-producing buttons of the same shape and size. This results not only in reduction of the cost of production but since replacement of the memory state and the non-memory state can be easily effected, the key words are sufficiently flexible at the time of use to meet with the requirements of the user, to say nothing of the fact that the same memory number can be set during production and wholesaling.

Since the key plate slidably disposed on the case frame is equipped with the slits meeting and engaging with the slots of the keys, the key plate is allowed to slide only when the key slots and key plate slits are in alignment by virtue of the button operation to provide proper engagement between keys in both the memory and non-memory states and the key plate.

Hence, a double guarantee is made that the handle is not capable of the unlocking operation in any other than the above-mentioned case. This provides the advantage of high safety.

In addition, when a button is kept in the memory state, it detachably engages with the lock plate that is likewise slidable with respect to the case frame, thereby keeping a kind of "flip-flop". Hence, an advantage can be obtained in that alignment and engagement with respect to all the button slots and the key plate can be obtained.

I claim:

1. In a button operated combination lock of the type in which a number of button operable actuator keys are disposed with the surfaces thereof accessible in a case frame so as to be capable of being set in a selected combination lock memory state and engaging with, and disengaging from, a key plate, said key plate being engaged with a bolt lock; the improvement wherein said key plate is slidably supported inside said case frame and has a number of slits bored at predetermined positions therein; all of said actuator keys being in the form of similar flat plates, each of said said keys being loosely inserted into a corresponding one of said slits and being retractable from said case frame; a transverse slot formed in each of siad keys intersecting and engaging with said key plate loosely, each of said slots running parallel to and being displaced longitudinallly from the transverse centerline of its associated key, said keys being set in said selected memory state by mounting a preselected set of said keys in said lock with the slots thereof displaced from the transverse centerline in a first direction relative to said key plate with the remainder of said keys being mounted in said lock in inverse relationship to the preselected keys with the slots thereof displaced from said transverse centerline in a direction opposite to said first direction, the slots thereof engaging the key slits when the keys are actuated; a lock plate slidably mounted in said case frame; said lock plate and said actuator keys each including means for detachably retaining said actuator keys to said lock plate; and handle means operative in an interlocking arrangement with said bolt lock and engaging with said key plate and with said lock plate for alternatively opening said lock or resetting said keys in the selected combination memory state by detaching said actuator keys from said lock plate.

2. The button operated combination lock as defined in claim 1 wherein said keys have an outer shape so as to be capable of being inverted and said slots are so formed as to enable selection of a memory position and an non-memory position, said keys being linearly symmetric when said keys are inverted.

3. The button operated combination lock as defined in claim 1 wherein said means for detachably retaining the actuator keys to the lock plate comprises notches formed at both end portions of said keys and hook springs disposed on said lock plate capable of hooking to said notches.

4. The button operated combination lock as defined in claim 1 wherein a set block having said key plate and said keys set thereto is screwed detachably to said case frame form the back of said case frame.

5. The button operated combination lock as defined in claim 1 wherein said handle includes a cam pin on one side thereof engaging with said lock plate and a cam pin on the other side thereof engaging with said lock plate.

6. The button operated combination lock as defined in claim 5 wherein said handle further includes a rack gear and a pinion, said rack gear having both of said cam pins thereon, said rack gear engaging said pinion.

* * * * *